United States Patent [19]

Bush

[11] Patent Number: 4,865,209

[45] Date of Patent: Sep. 12, 1989

[54] CHILD RESISTANT CLOSURE

[75] Inventor: Randall Bush, Evansville, Ind.

[73] Assignee: Sunbeam Plastics Corporation, Evansville, Ind.

[21] Appl. No.: 223,922

[22] Filed: Jul. 25, 1988

[51] Int. Cl.[4] ..... B65D 55/02

[52] U.S. Cl. ..... 215/216; 215/219

[58] Field of Search ..... 215/203, 216, 217, 218, 215/219, 221, 225

[56] References Cited

U.S. PATENT DOCUMENTS

| | | | |
|---|---|---|---|
| 3,422,978 | 1/1969 | Quackenbush . | |
| 3,468,444 | 9/1969 | Martin, Jr. | 215/219 X |
| 3,679,085 | 7/1972 | Gach . | |
| 3,817,416 | 6/1974 | Costa . | |
| 3,841,514 | 10/1974 | Montgomery et al. | 215/216 |
| 3,877,597 | 4/1975 | Montgomery et al. | 215/221 |
| 3,894,647 | 7/1975 | Montgomery . | |
| 3,989,152 | 11/1976 | Julian | 215/216 |
| 4,011,829 | 3/1977 | Wachsmann et al. | 215/216 X |
| 4,149,646 | 4/1979 | Julian | 215/216 |
| 4,220,247 | 9/1980 | Kramer | 215/219 |
| 4,446,979 | 5/1984 | Gach et al. | 215/203 |
| 4,572,385 | 2/1986 | Luker | 215/216 |
| 4,603,785 | 8/1986 | Gach | 215/230 |

*Primary Examiner*—Stephen Marcus
*Assistant Examiner*—Nova Stucker
*Attorney, Agent, or Firm*—Gifford, Groh, Sheridan, Sprinkle and Dolgorukov

[57] ABSTRACT

A child resistant closure having a visible external locking tab which cooperates with a locking stop on a container. A threaded inner cap remains sealed while the child resistant locking tab is locked from the position of locking to a tightened position. An outer cap is rotated to engage cooperating drive means for closing or opening the closure. When the closure is reapplied, the user is assured that it is sealed when he observes that the child resistant tab is engaged.

8 Claims, 1 Drawing Sheet

Fig-1
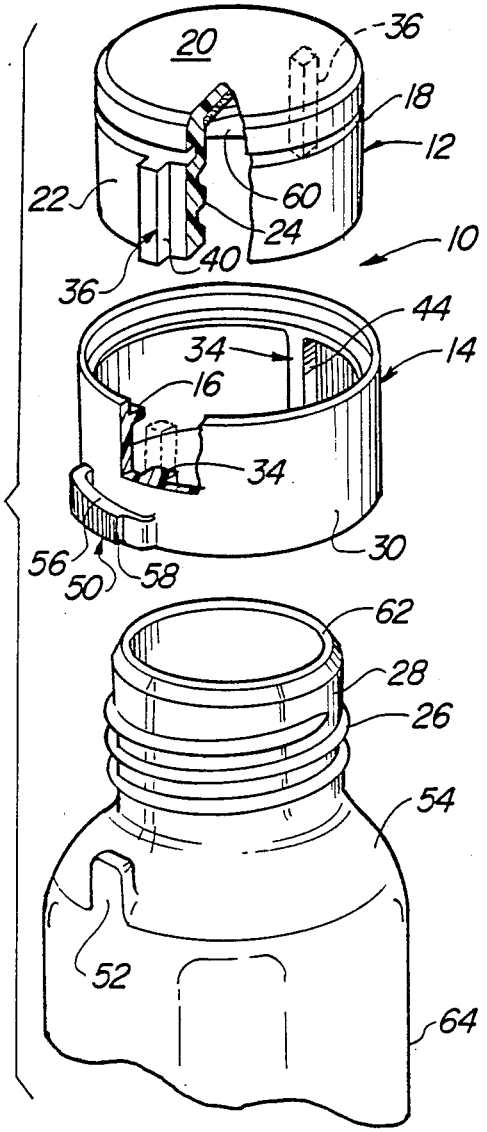
Fig-2
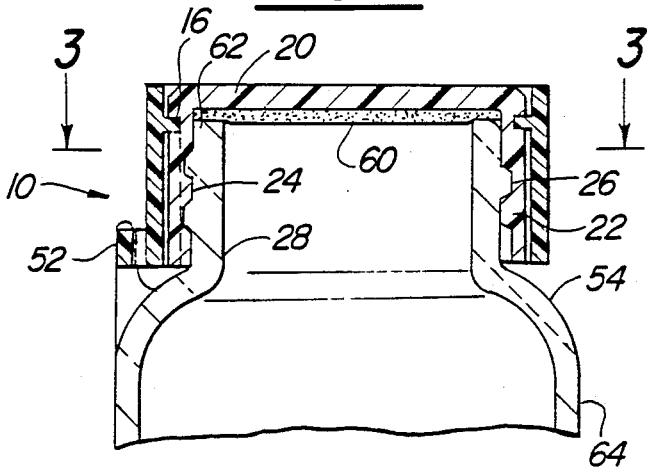
Fig-3
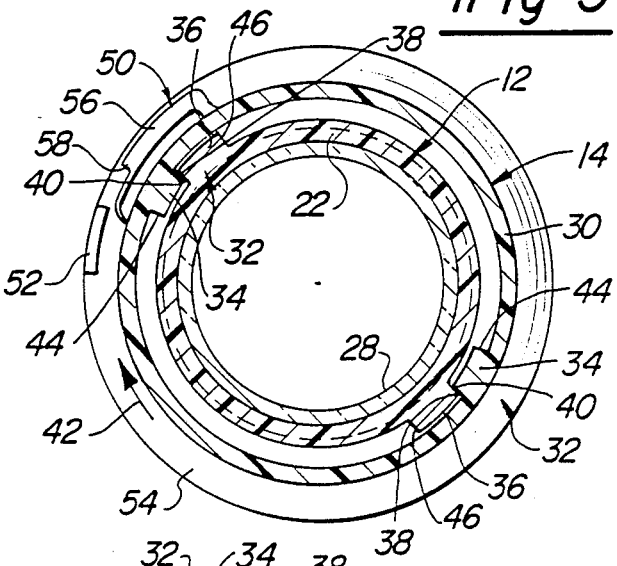
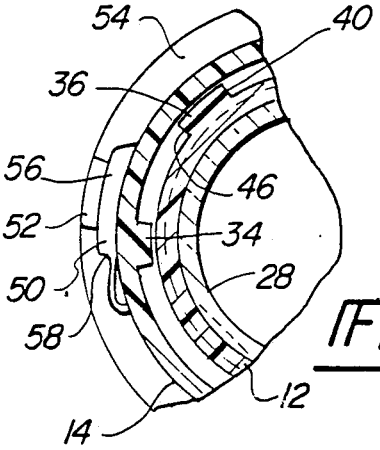
Fig-4
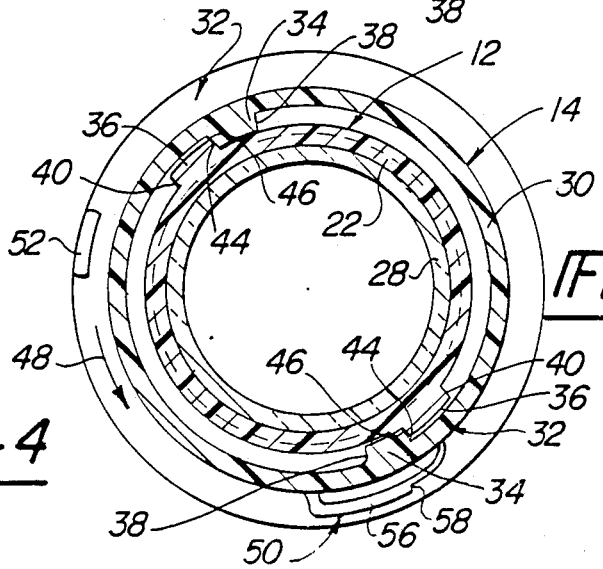
Fig-5

CHILD RESISTANT CLOSURE

This invention relates to closures for containers, and, more particularly to a child resistant closure.

There are a wide variety of child resistant closures available. The more successful closures require two separate and dissimilar movements or actions to remove the closure. These movements can be simultaneous or sequential. Some closures give a visual indication when they have been resecured in a child resistant position or condition. This does not necessarily guarantee that the closure has been sealed to the container. Sealing is particularly important in the case of a liquid product.

This invention is directed to a child resistant closure that has an external locking device which provides a visual indication as the closure is being reapplied to the container that it has been restored to its child resistant condition.

This invention is also directed to a child resistant closure in which the closure seals to the container when the child resistant feature becomes effective and remains sealed through any additional threading on to a tightened position or unthreading until the child resistant feature has been released.

The closure of this invention is for use on a container having a locking stop and a threaded neck. The closure has an inner sealing cap and an outer driver cap. The inner cap has a substantially flat top and an annular skirt having internal threads which engage the container neck threads. The outer cap has an annular skirt which telescopingly receives the inner skirt for relative rotation. Cooperating drive means between on the inner and outer caps are arranged to engage and turn the inner cap in threading and unthreading relationship to the container neck threads as the outer cap is turned. A resilient sealing member, usually in the form of a compressible resilient gasket or liner is located underneath the top of the inner cap and is adapted to seal the end of the container neck to the inner cap. A locking tab on the outer cap skirt is arranged to pass by the container locking stop as the outer cap is turned in a threading direction to put the closure into a locked child resistant position. The locking tab remains in the child resistant position as the outer cap further threads the inner cap to a tightened position. The sealing member maintains its seal from the tightened position to at least the point where the locking tab is released from the locking stop in the opening of the child resistant closure.

The cooperating drive means does not engage the outer cap with the inner cap until the locking tab has passed the locking stop in an unthreading direction. This assures that the container remains sealed until the locking tab has been turned past the locking stop in an unthreading direction, and it also assures that when the closure is reapplied to the container neck that the container is sealed when the locking tab is in its child resistant position past the locking stop.

The locking tab is preferably deflectable, and it passes over or deflects to clear the locking stop as the closure is threaded onto the container. The locking tab must be manually deflected to clear the container locking stop as the closure is unthreaded. In a preferred form, the locking tab extends radially outward from the outer cap to engage the locking stop which is spaced radially outward from the container neck. The locking tab is released by squeezing it inwardly toward the neck to clear the locking stop as the outer cap is rotated in an unthreading direction.

The cooperating drive mechanism includes an on-driver and an off-driver surface on the outer cap which engage an on-drive and an off-drive surface on the inner cap. The surfaces are arranged so that when the on-driver surface is in engagement with the on-drive surface at the tightened position of the closure, the outer cap must be rotated in an unthreading direction to a greater angle than the angle between the tightened position and the locking stop to engage the off-driver surface with the off-drive surface. That is, there is no engagement of the outer cap with the inner cap until a child resistant locking tab has been released from the container locking stop. In a preferred embodiment the drive takes the form of a pair of diametrically opposed driver lugs projecting radially inward from the outer cap with each of the driver lugs having an on-driver and an off-driver surface. These cooperate with a pair of diametrically opposed drive lugs projecting outwardly from the inner cap with each of the drive lugs having an on-drive and an off-drive surface.

The presently preferred embodiments are illustrated in the accompanying drawing in which:

FIG. 1 is an exploded perspective view of the closure with portions broken away showing the inner cap as it will be assembled to the outer cap and the closure applied to a container neck;

FIG. 2 is a sectional elevational view taken through the container locking stop;

FIG. 3 is a cross sectional view taken along line 3—3 of FIG. 2 showing the locking tab rotated past the container locking stop in its child resistant condition and the cooperating drive means in position to transmit the closing motion of the outer cap to the inner cap and with the closure in a fully tightened position; and FIG. 4 is a partial cross sectional view similar to FIG. 3 but showing the locking tab on the outer cap squeezed inwardly as it passes the container locking stop;

FIG. 5 is a cross sectional view taken along line 3—3 of FIG. 2 with the locking tab in a disengaged position and the cooperating drive means in a position to transmit the opening motion of the outer cap of the inner cap.

Referring to the drawing, the two piece closure 10 is shown as including an inner cap 12 and an outer cap 14 which are rotatably held together by an inwardly directed flange 16 on outer cap 14 which snaps into circumferential groove 18 on the inner cap. Inner cap 12 has a planar top 20 and a depending skirt 22 which has internal threads 24 which engage complementary threads 26 on container neck 28 to secure the closure to the container.

Skirt 30 of outer cap 14 extends the entire height of inner cap skirt 22 so that the inner cap 12 cannot be threaded onto the container neck directly. Cooperating drive means 32 are provided between the inner and outer cap so that rotation imparted to the outer cap will be transmitted to the inner cap to thread it onto the container neck 28 or to unthread it for removal of the closure.

Drive means 32 takes the form of a pair of diametrically opposed inwardly directed driver lugs 34 on outer cap 14 which cooperate with outwardly directed drive lugs 36 on inner cap 12. As seen in FIG. 3, radially extending on-driver surfaces 38 on driver lugs 34 cooperate with radially extending drive-on surfaces 40 of drive lugs 36 so that as the outer cap 14 is turned in a clockwise direction as indicated by arrow 42, the outer cap drives the inner cap into threading engagement with the container neck. FIG. 3 shows the inner cap threaded onto the container to its fully tightened position. To unthread the closure 10 from container neck 28, the outer cap 14 must be rotated through an angle of almost 180° from the position shown in FIG. 3 to the position shown in FIG. 5 so that radially extending off-driver surfaces 44 of driver lugs 34 come into contact with radially extending off-drive surfaces 46 on drive lugs 36. As the outer cap 14 is rotated further in a counter clockwise direction as shown by arrow 48 in FIG. 5, the inner cap 12 is unthreaded from the container neck 28.

The child resistant locking tab 50 of the type shown in U.S. Pat. No. 3,989,152 to Julian extends radially outward from outer cap 14 for cooperation with container stop 52. The container stop 42, as best seen in FIG. 1, takes the form of an abuttment on the container shoulder 54 which is spaced from the container neck 28. As the outer cap 14 is turned in a clockwise direction, locking tab 50 passes over container stop 52 or alternatively it is forced inwardly by the stop 52 as it passes it as shown in FIG. 4. Once the lug 50 passes the container stop 52, the web portion 56 assumes the position shown in FIG. 3 so that stop surface 58 at the end of web 56 is in alignment with the container stop 52. In order to release the child resistant lock, web 56 must be pressed inwardly towards the container neck 28 so that stop surface 58 will pass inwardly by the container stop 52 as shown in FIG. 4.

A resilient sealing liner 60 underlies the top 20 of inner cap 12 and is arranged to engage the end or lip 62 of container neck 28 to effect a seal between the inner cap 12 and the container 64 as the inner cap is turned onto the neck by rotation of the outer cap 14. The thickness and composition of the liner is chosen to accomodate the normal variation in manufacturing tolerances for the container neck threads and inner cap threads. Once the initial sealing is effected by contact of the container lip 62 with the liner 60, an additional sealing compression of at least 90° is provided so that the inner cap is always sealed when the closure in its child resistant condition. An additional tightening of up to 90° is possible from a position where the locking tab is in alignment with the container stop to the finally tightened position as shown in FIG. 3. This likewise assures that the container remains sealed until the locking tab 50 has been turned past the locking stop 52 in an unthreading direction. The user is also assured that when the closure is reapplied to the container neck, that the container is sealed when the locking tab is in its child resistant position past the locking stop. Although a separate resilient sealing gasket or insert is preferred, a depending annular sealing fin may be integrally molded with the cap as long as sufficient resiliency is provided to accomplish the desired range of sealing.

It will be appreciated that while two diametrically opposed radially extending driver lugs on the outer cap and two diametrically opposed radially extending drive lugs on the inner cap are illustrated, one or more than two drivers and drive lugs can be used. Moreover there can be separate lugs for the on-drive and off-drive surfaces on the outer cap as well as separate lugs for the on-drive and off-drive surfaces on the inner cap. Also the driver and drive lugs could be located on the tops of the inner and outer cap. The critical requirement is that the outer cap must be rotated farther from the fully tightened position to the unthreading engagement of the outer and inner caps than the rotation to unlock the child resistant locking tab. That is, the locking tab is unlocked before the off-driver and off-drive surfaces come into contact. Also the inner cap must remain sealed while the child resistant locking tab is locked.

The embodiments of the invention in which an exclusive property or privilege is claimed are defined as follows:

1. A child resistant closure for use on a container having a locking stop and a threaded neck comprising, in combination:

an outer cap having an annular skirt;

an inner cap within and rotatably attached to said outer cap and having a substantially flat top and an annular skirt with internal threads for engagement with said container neck;

cooperating drive means on said inner and outer caps arranged to engage and turn said inner cap in threading and unthreading relationship to said container neck threads as said outer cap is turned;

a resilient sealing member arranged to engage the end of said container neck to effect a seal between said inner cap and said container as said inner cap is turned onto said neck by rotation of said outer cap;

a locking tab on said outer cap skirt which is put into a locked child resistant condition when it passes said container locking stop as the outer cap is being turned to thread the inner cap onto said container neck to a tightened position, said sealing member maintaining said seal a said inner cap is rotated between said stop and said tightened position, said outer cap being free to turn in an unthreading direction beyond said locking stop when said locking tab is released from said locking stop, and said cooperating drive means being engaged to unthread said inner cap after said locking tab passes said locking stop in an unthreading direction;

thereby assuring said container remains sealed until said locking tab has been turned past said locking stop in an unthreading direction, and assuring that when said closure is reapplied to the container neck that the container is sealed when the locking tab is in its child resistant position past said locking stop.

2. A child resistant closure according to claim 1 wherein said outer cap has an inwardly directed flange which rotatably engages a recess on said inner cap.

3. A child resistant closure according to claim 1 wherein said sealing member includes a resilient liner underlying the top of said inner cap adapted to be compressed against the end of said container neck.

4. The child resistant closure of claim 1 wherein said locking tab is deflectable to clear said locking stop as it is released therefrom.

5. The child resistant closure according to claim 4 wherein said locking tab extends radially outward from said outer cap to engage said locking stop which is spaced radially outward from said neck, and said locking tab is released by squeezing inwardly toward said neck to clear said locking stop as said outer cap is rotated in an unthreading direction.

6. The child resistant closure according to claim 1 wherein said cooperating drive means includes on-driver and off-driver surfaces on said outer cap which engage on-drive and off-drive surfaces on said inner cap, said surfaces being so spaced that when said on-driver surface is in engagement with said on-drive surface at said tightened position, said outer cap must be rotated in an unthreading direction a greater angle than the angle between said tightened position and said locking stop to engage said off-driver surface with said off-drive surface.

7. The child resistant closure according to claim 6 wherein said cooperating drive means includes a pair of diametrically opposed driver lugs projecting radially inward from said outer cap, each driver lug having an on-driver and an off-driver surface, and a pair of diametrically opposed drive lugs projecting outwardly from said inner cap, said drive lugs each having an on-drive and an off-drive surface.

8. A child resistant closure for use on a container having a locking stop and a threaded neck comprising, in combination:

an outer cap having an annular skirt with inwardly projecting on-driver and off-driver surfaces;

an inner cap within and rotatably attached to said outer cap and having a substantially flat top and an annular skirt with internal threads for engagement with said container neck and outwardly projecting on-drive and off-drive surfaces which are engaged by said on-driver and off-driver surfaces respectively when said outer cap is being turned to thread the inner cap onto said container neck to a tightened position and when the cap is being turned to unthread said inner cap from said container neck;

a resilient sealing member arranged to engage the end of said container neck to effect a seal between said inner cap and said container as said inner cap is turned onto said neck rotation of said outer cap;

a locking tab on said outer cap skirt which is put into a locked child resistant condition when it passes said container locking stop as the outer cap is being turned to thread the inner cap onto said container neck to said tightened position, said sealing member maintaining said seal as said inner cap is rotated between said stop and said tightened position, said off-driver and off-drive surfaces being so positioned relative to said on-driver and on-drive surfaces that said outer cap must be turned in an unthreading direction beyond said locking stop when said locking tab is released from said locking stop before said off-driver and off-drive surfaces are engaged to unthread said inner cap;

thereby assuring said container remains sealed until said locking tab has been turned past said locking stop in an unthreading direction, and assuring that when said closure is reapplied to the container neck that the container is sealed when the locking tab is in its child resistant position past said locking stop.

* * * * *